US005501440A

United States Patent [19]

Blise

[11] Patent Number: 5,501,440

[45] Date of Patent: Mar. 26, 1996

[54] VISE

[76] Inventor: Bernard G. Blise, 3524-11th Ave., Kenosha, Wis. 53140

[21] Appl. No.: 272,023

[22] Filed: Jul. 8, 1994

[51] Int. Cl.[6] ..... B25B 1/10

[52] U.S. Cl. ..... 269/253

[58] Field of Search ..... 269/250, 251, 269/252, 253, 246, 97, 98, 111

[56] References Cited

U.S. PATENT DOCUMENTS

| | | | |
|---|---|---|---|
| 152,350 | 6/1874 | Dubrul . | |
| 1,334,732 | 3/1920 | Bergstrom | 269/252 |
| 1,335,721 | 4/1920 | Bergstrom | 269/250 |
| 2,450,303 | 9/1948 | Sasgen . | |
| 2,880,638 | 4/1959 | Muggli et al. . | |
| 3,170,708 | 2/1965 | Muller . | |
| 4,613,120 | 9/1986 | Kozar . | |
| 5,172,895 | 12/1992 | Klimach . | |

*Primary Examiner*—Robert C. Watson
*Attorney, Agent, or Firm*—Arthur J. Hansmann

[57] ABSTRACT

A vise having two spaced-apart end plates and a plurality of tie rods extending therebetween for accurately and firmly retaining the plates in a fixed spaced-apart positioning. Two workpiece clamping jaws are supported relative to the plates, and a force applicator is connected to one of the jaws and is within the confines of the connectors or tie rods between the plates for applying the clamping force within the boundaries of the tie rods for absolute accuracy and strength. The vise can be clamped to a worktable in one of two positions for positioning the workpiece either vertically or horizontally. A split retainer ring is utilized for the accurate assembly of the tie rods and the plates.

20 Claims, 2 Drawing Sheets

VISE

This invention relates to a vise for use preferably in industrial applications.

BACKGROUND OF THE INVENTION

The prior art is aware of many different configurations of vises which are reasonably accurate and sturdy for holding workpieces which can be worked upon by machining or the like, for instance. Examples of such prior art are seen in U.S. Pat. Nos. 152,350; 3,170,708; 2,450,303; 2,880,638; 4,613,120; and 5,172,895. Those and other prior art disclosures differ from the present invention wherein there is an exceptionally accurate and sturdy vise for supporting workpieces, particularly workpieces involved in extraordinarily accurate industrial machining or the like.

The vise of the present invention does not utilize nor rely upon threaded members for retaining the vise in its assembled condition. Therefore, the accuracy of the vise is enhanced over that of the prior art. Further, the strength or sturdiness of the vise is improved in that threaded members are not utilized for countering the clamping force of the vise, and the clamping force is applied centrally relative to the location of the workpiece itself so that there is no offset location of the clamping force on the workpiece. Thus, the vise of this invention can be utilized with either manual cranking or powering or a power cylinder or the like, in the clamping action.

Additionally, this vise is arranged so that it can be accurately positioned in either one of two positions, that is, either on what is termed a bottom edge of the vise or on a side edge of the vise, with the edges resting on a worktable.

Still further, the V-blocks utilized in this vise can be readily interchanged for selective sizing, and the V-blocks are positioned on the inner section of the axis with the force applicator or screw which moves the clamping jaws into clamping position. In that arrangement, the clamping force is applied within the boundary defined by the tension members which are retaining the vise in its assembled position, and thus maximum clamping force can be applied within the extreme strength of the vise when arranged as described herein.

Additionally, this vise is arranged so that the moving jaw of the two clamping jaws for the workpiece is accurately and slidably supported on the tension members which are holding the vise in the assembled position. Therefore, the moving jaw is accurately guided with virtually no play tolerance, and the jaw receives support from the tension members mentioned.

Figure 1:
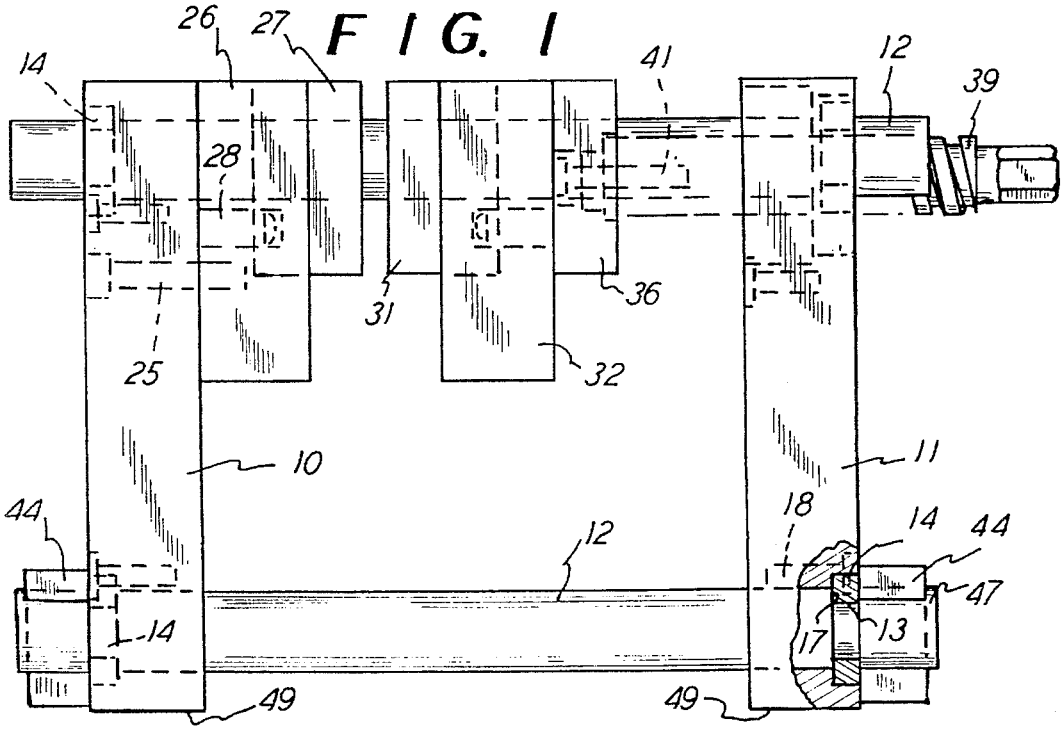
FIG. 1 is a side elevational view of a preferred embodiment of this invention.

Fig, 4 is a side elevational view of a fragment of the tension member shown in FIG. 1 and being shown in an enlargement.

Figure 5:
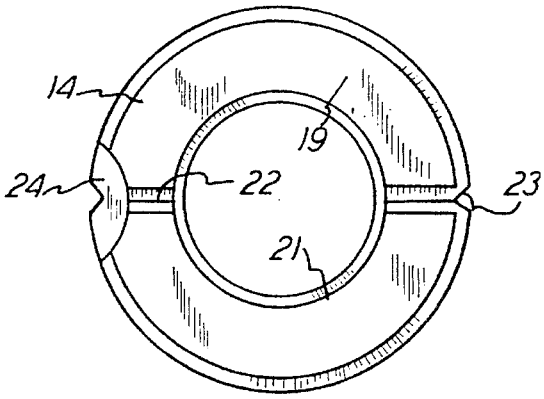

FIG. 5 is an axial view of an annular retainer shown in FIG. 1, but in an enlarged view.

Figure 6:
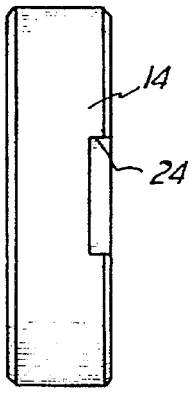

FIG. 6 is a left side elevational view of FIG. 5.

DETAILED DESCRIPTION OF THE PREFERRED EMBODIMENT

Figure 2:
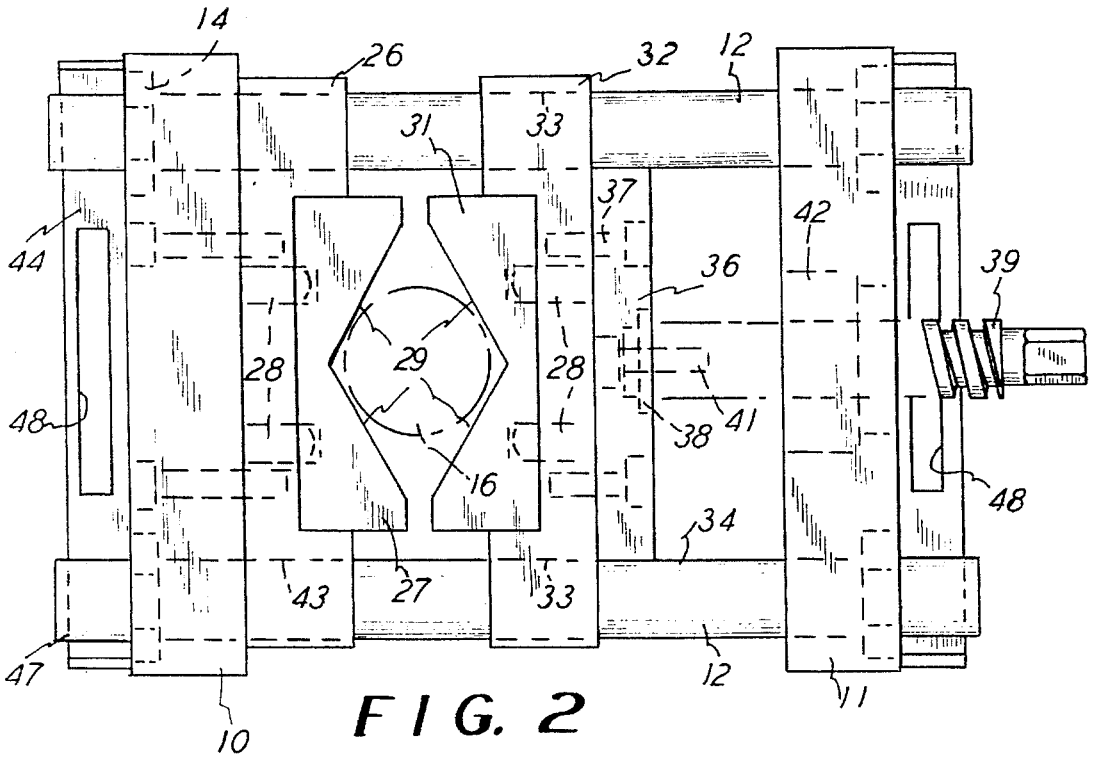
FIG. 2 is a top plan view of FIG. 1.
Figure 3:
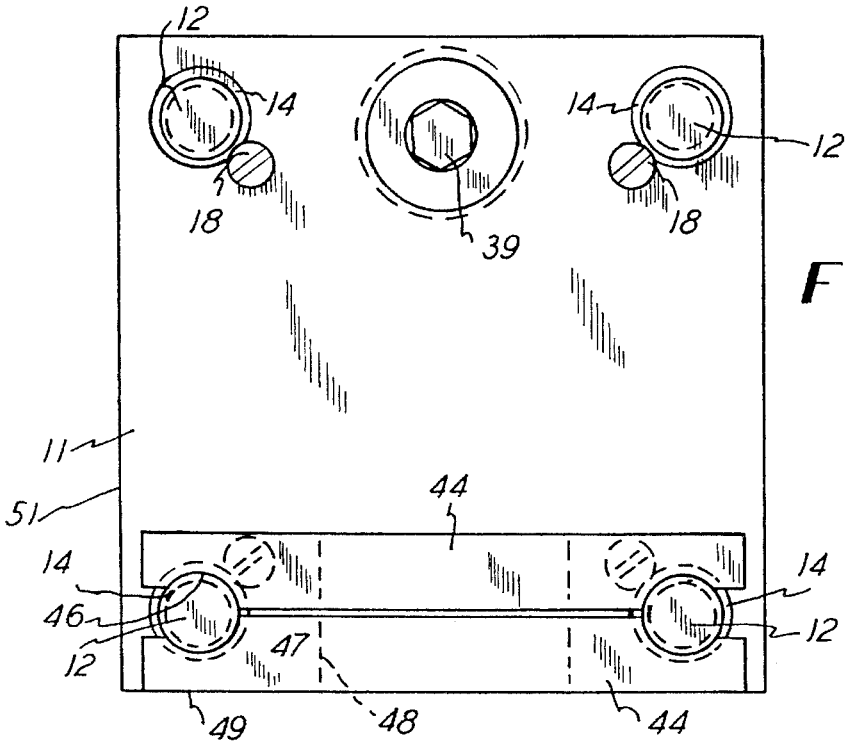
FIG. 3 is a right end elevational view of FIG. 1.

The vise includes two spaced-apart end plates 10 and 11 which are planar in configuration, as seen in FIGS. 1 and 2 and they are of the same overall dimensions in both the thickness seen in FIGS. 1 and 2 and in the square configuration seen in FIG. 3. These end plates 10 and 11 are configured to therefore occupy the same square space, as seen in FIG. 3 and, except for some differences in machining as described hereinafter, the plates 10 and 11 are identical at least in overall dimensions.

Figure 4:
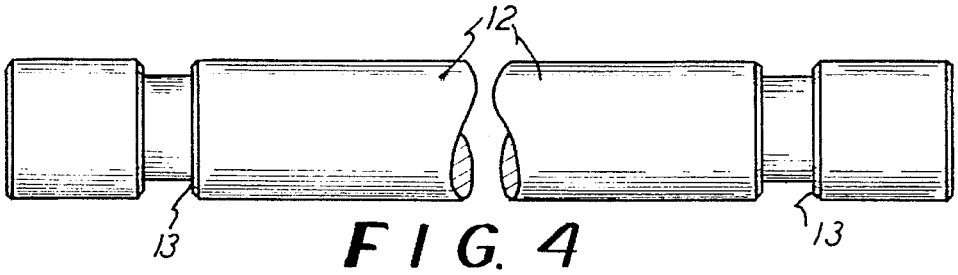

Four identical tie rods 12 extend between the respective four corners of each plate 10 and 11, and the rods 12 retain the plates 10 and 11 in the spaced-apart position shown in FIGS. 1 and 2. The rods 12 are elongated cylindrical rods, of solid configuration, except for grooves or recesses 13 in opposite ends of the rods 12, as best seen in FIG. 4. With that arrangement of the end plates 10 and 11 and the four rods 12, the plates 10 and 11 remain parallel to each other.

Each recess or groove 13 and each end of each rod 12 receives an annular ring or retainer 14 which nests into the base of each groove 13 and which extends radially beyond the outer circumference of the rod 12, as shown in the broken-away section of the lower right-hand corner of FIG. 1. Thereby, the tie rods 12 with the two retainers 14 at each of the ends of the tie rods 12 restrain the plates 10 and 11 from moving away from each other, and by that arrangement the clamping force can be applied onto the workpiece in the sturdy and extraordinarily accurate arrangement mentioned at the outset. FIG. 2 shows that a cylindrical workpiece 16 is disposed within the vise, and by means hereinafter described, the clamping force mentioned is applied to that workpiece 16, for instance.

With the four tie rods 12 and the annular restrainer 14 on each end of each tie rod, the plates 10,11 present outwardly facing annular shoulders 17 which restrain the plates 10 and 11 from any movement away from each other. Accordingly, the end plates 10 and 11 are held in exact true positions of parallelism and the like and are held against any movement, including deflection, away from each other. Also, to restrain the plates 10 and 11 from moving inwardly toward each other, each annual restrainer 14 is overlapped by a screw 18 extending into the respective plate 10 and 11 and overlapping the respective restrainer 14, as shown in FIGS. 1 and 3.

FIGS. 5 and 6 show that each restrainer 14 is initially in a complete ring or annular configuration, but each annular restrainer 14 is then split into two semi-circular halves 19 and 21 with the split existing along the horizontal center line 22. That is, the restrainer 14 is initially made in one continuous ring form, but has an indentation 23 which receives a force for splitting each ring 14 into the two halves 19 and 21. As such, the ring 14 is true and accurate both before and after being split, and of course the ring can be then nested in each annular groove 13 of the pins 12, for the assembly described herein.

Also, FIGS. 5 and 6 show that each ring 14 has a recess 24 which receives the edge of the head of the retaining screw 18, as previously described.

A stationary clamping jaw 26 is suitably mounted on the upper end of the plate 10, such as by screws 25 as shown, and the jaw carries a jaw insert 27 which can be aligned with and retained on the base jaw 26 by means of a pair of dowels 28. Of course the jaw 27 presents a V-opening 29 to the workpiece 16 and is complimentary to a jaw insert 31 which is carried on a movable jaw 32 suitably supported by snugly sliding on the two upper pins 12. That is, the jaw 32 has two cylindrical openings 33 which snugly receive the circumference of the two upper pins 12 to be slidable thereon, and the openings 33 are of substantially the same size as the circumferences 34 of the pins 12 for the snug and accurate sliding relationship mentioned.

A thrust plate 36 is suitably connected to the jaw 32, such as by screws 37, and a thrust bearing member 38 is carried by the plate 36. A screw 39 is shown connected with the plate 36, such as by the screw 41, and the screw 39 is threadedly related to the plate 11, such as by means of the threaded bushing 42 mounted in the plate 11, as shown in FIGS. 1 and 2.

Accordingly, rotation of the screw 39 will cause the movable jaw 32 to move toward or away from the stationary jaw 26 for purposes of respectively clamping and releasing the workpiece 16, It will also be noted that the longitudinal axis of the screw 39, which is the force-application axis of the vise, is within the boundaries defined by the four pins 12, and thus the force-application on the workpiece 16 is supported by and within the boundaries of the pins 12, rather than being outside those boundaries or in an offset and thus inherently weak position. FIG. 1 shows that the screw 29 is lower than the upper limit of the upper pins 12, and thus the aforementioned boundary confinement of the screw 39 prevails.

Also, the stationary jaw 26 has two cylindrical openings 43 which respectively receive pins 12 in a snug relationship so that the stationary jaw 26 is firmly and non-movably included in the assembly described.

FIGS. 1 and 3 show a clamp bar 44 extending between the two lower pins 12 and having an arcuate downwardly faced opening 46 which is in conformance with the outer circumference of the ends 47 of the pins 12. Accordingly, the clamp bars 44 hold the lower pins 12 downwardly, and the clamp bars are provided with openings 48 through which mounting bolts can be disposed for clamping the vise to a table top (unshown) therebelow. FIG. 3 also shows there is a lower clamp bar 44 below the pin ends 47, and thus even further stability can be achieved with the entrapment of the pin ends 47 for the clamping purposes mentioned.

FIGS. 1 and 3 also show that the lower edges 49 of the plates 10 and 11 are on the same plane and therefore can be disposed in flat and full contact position with the upper surface of the unshown worktable, for stability and the clamping mentioned, Also, either side of the vise, such as the side 51 shown in FIG. 3 can have its plate edges along that side parallel and on the same plane for the purpose of clamping the vise assembly in the side-down position on the worktable. Accordingly, the workpiece 16 can be presented in either axially aligned position relative to the working tool, that is either horizontal or vertical. In that side-down arrangement, the left side pins 12, as viewed in FIG. 3, would be engaged by the clamp bar 44, and the arrangement is such that there is sufficient clearance for positioning the clamp-down bar 44 on the side of the vise for that orientation.

With a vise of superior accuracy, squareness is required so threads on tie rods are unsatisfactory, thus the split rings are employed and give a tolerance of 0.001 inches in trueness in assembly and all dimensions are controlled including the rod groove, the end plate counter borders, the ring dimensions, and the like, With this trueness, four or so of these vises can be placed side by side and all will give the same tolerances on the four workpieces therein. Also, very large compressive forces can be applied with the arrangement described herein. With the right-angled sides 49 and 51, the side- by-side accuracy is achieved with the two adjacent vises being in contact with their sides 51.

What is claimed is:

1. A vise comprising two spaced-apart end plates rectangular in shape in the projection toward each other, a plurality of four tie rods, each of said corners of said end plates has an opening therein, said tie rods extend in respective ends through said openings, each of said ends of said tie rods has a groove therein, restrainer disposed in each of said grooves for establishing a fixed spaced-apart relationship of said end plates, a pair of jaws supported on said assembly and with one of said jaws being supported directly on some of said tie rods and being movable toward the other of said jaws for clamping a workpiece between said jaws and along a line within the confines defined by the positions of said rods, and a compressive force applicator connected with said one jaw and being arranged and located to have its compressive force action applied only centrally along said line.

2. The vise as claimed in claim 1, wherein each of said grooves is annular, and each of said restrainers is annular and in two semi-circular half-pieces nested in said grooves and disposed on the respective sides of said end plates which are faced away from each other for establishing said spaced-apart relationship of said end plates.

3. The vise as claimed in claim 1, wherein each of said grooves of said tie rods is a single annular recess disposed respectively adjacent one of said end plates, and each of said restrainers are respectively disposed in each of said recesses and in abutment with respective ones of said end plates for the spaced-apart relationship of said end plates.

4. The vise as claimed in claim 3, wherein each said restrainer is annular and exists in two semi-circular half-pieces for respectively nesting in each of said recesses.

5. The vise as claimed in claim 1, wherein said movable jaw is snugly slidable supported on two of said tie rods for the movable support of said movable jaw.

6. The vise as claimed in claim 1, wherein each end of each of said tie rods is threadless and each of said grooves is respectively disposed adjacent one of said end plates, and each of said restrainers is respectively disposed in each of said grooves and is in respective abutment with a respective one of said end plates for the spaced-apart relationship of said end plates.

7. The vise as claimed in claim 1, wherein each of said tie rods is threadless and each of said grooves is an endless annular groove, and an annular restrainer respectively nested in each of said grooves and being in respective abutment with said one of said end plates for the spaced-apart relationship of said end plates.

8. The vise as claimed in claim 1, wherein each end of each of said tie rods is threadless, and each of said restrainers is an annular restrainer respectively nested in each of said grooves and in abutment with a respective one of said end plates for the spaced-apart relationship of said end plates.

9. The vise as claimed in claim 1, wherein said movable jaw has two openings therein for slidably mounting on said some of said tie rods for the movable support of said movable jaw on said some of said tie rods.

10. The vise as claimed in claim 1, including a hold-down member in contact with said tie rods for fastening said assembly to a work table.

11. The vise as claimed in claim 1, wherein said end plates are each shaped with two respective adjacent edges, each said two respective edges being located on two respective common planes for supporting said assembly on a work table on a selected either one of said two respective edges.

12. A vise comprising two spaced-apart end plates, a plurality of threadless tie rods disposed to thereby define a boundary and being fixedly connected at their opposite ends to said end plates to form an assembly therewith and have said end plates retained in fixed spaced-apart relationship, a pair of jaws supported on said assembly and with one of said jaws being supported directly on some of said tie rods and being slidably movable on said some of said tie rods and toward the other of said jaws for clamping a workpiece between said jaws and along a line located within said boundary defined by said tie rods, and a compressive force applicator supported on said assembly and connected with said one jaw and being arranged and located to have its compressive force action applied only centrally along said line.

13. The vise as claimed in claim 12 wherein each of said tie rods has a recess therein adjacent one of said end plates, and a restrainer disposed in each said recess and in abutment with said one of said end plates for the spaced-apart relationship of said end plates.

14. The vise as claimed in claim 13, wherein each said restrainer is annular and exists in two semi-circular half-pieces for nesting in said recesses.

15. The vise as claimed in claim 12, wherein said one off said jaws completely encircles, and is slidably mounted on said some of said tie rods for sliding movement of said one jaw on said some of said tie rods.

16. A vise comprising two spaced-apart end plates, a plurality of tie rods connected at their opposite ends to said end plates to form an assembly therewith and have said end plates retained in fixed spaced-apart relationship, wherein each of said tie rods has a single annular recess therein adjacent one of said end plates, a restrainer respectively disposed in each said recess and in abutment with said one of said end plates for the spaced-apart relationship of said end plates, a pair of jaws supported on said assembly and with one of said jaws being supported directly on some of said tie rods and being movable toward the other of said jaws for clamping a workpiece between said jaws and along a line within the confines defined by the positions of said rods, and a compressive force applicator connected with said one jaw and being arranged and located to have its compressive force action applied only centrally along said line.

17. The vise as claimed in claim 16, wherein each said restrainer is annular and exists in two semi-circular half-pieces for nesting in said recess.

18. A vise comprising two spaced-apart end plates, a plurality of tie rods connected at their opposite ends to said end plates to form an assembly therewith and have said end plates retained in fixed spaced-apart relationship, each of said tie rods is threadless and has an endless annular groove therein adjacent one of said end plates, an annular restrainer respectively nested in each said groove and being in abutment with said one of said end plates for the spaced-apart relationship of said end plates, a pair of jaws supported on said assembly and with one of said jaws being supported directly on some of said tie rods and being movable toward the other of said jaws and along a line within the confines defined by the positions of said rods, and a compressive force applicator connected with said one jaw and being arranged and located to have its compressive force action applied only centrally along said line.

19. A vise comprising two spaced-apart end plates, a plurality of tie rods connected at their opposite ends to said end plates to form an assembly therewith and have said end plates retained in fixed spaced-apart relationship, a hold-down member in contact with said tie rods for fastening said assembly to a work table, a pair of jaws supported on said assembly and with one of said jaws being supported directly on some of said tie rods and being movable toward the other of said jaws for clamping a workpiece between said jaws and along a line within the confines defined by the positions of said rods, and a compressive force applicator connected with said one jaw and being arranged and located to have its compressive force action applied only centrally along said line.

20. A vise comprising two spaced-apart end plates, a plurality of tie rods connected at their opposite ends to said end plates to form an assembly therewith and have said end plates retained in fixed spaced,apart relationship, said end plates are each shaped with two respective adjacent edges, each said two respective edges being located on two respective common planes for supporting said assembly on a work table on a selected either one of said two respective edges, a pair of jaws supported on said assembly and with one of said jaws being supported directly on some of said tie rods and being movable toward the other of said jaws for clamping a workpiece between said jaws and along a line within the confines defined by the positions of said rods, and a compressive force applicator connected with said one jaw and being arranged and located to have its compressive force action applied only centrally along said line.

* * * * *